US008479765B1

(12) United States Patent
Wren

(10) Patent No.: US 8,479,765 B1
(45) Date of Patent: Jul. 9, 2013

(54) WATER FAUCET ASSEMBLY

(76) Inventor: Timothy Wren, Magnolia, TX (US)

( * ) Notice: Subject to any disclaimer, the term of this patent is extended or adjusted under 35 U.S.C. 154(b) by 314 days.

(21) Appl. No.: 12/829,144

(22) Filed: Jul. 1, 2010

(51) Int. Cl.
*E03B 7/07* (2006.01)

(52) U.S. Cl.
USPC ..... 137/551; 251/129.04; 4/623

(58) Field of Classification Search
USPC ..... 137/551; 251/129.04; 4/623, 668
See application file for complete search history.

(56) References Cited

U.S. PATENT DOCUMENTS

| | | | | |
|---|---|---|---|---|
| 4,749,126 | A * | 6/1988 | Kessener et al. | 239/12 |
| 4,894,874 | A | 1/1990 | Wilson | |
| 4,901,922 | A * | 2/1990 | Kessener et al. | 239/12 |
| 5,577,660 | A * | 11/1996 | Hansen | 236/12.12 |
| 5,868,311 | A * | 2/1999 | Cretu-Petra | 236/12.12 |
| D415,560 | S | 10/1999 | Lindholm | |
| 6,037,873 | A * | 3/2000 | Preston | 340/618 |
| 6,805,458 | B2 * | 10/2004 | Schindler et al. | 362/96 |
| 6,968,860 | B1 | 11/2005 | Haenlein et al. | |
| 7,008,073 | B2 * | 3/2006 | Stuhlmacher, II | 362/96 |
| 7,150,293 | B2 | 12/2006 | Jonte | |
| 7,270,748 | B1 * | 9/2007 | Lieggi | 210/198.1 |
| 7,303,299 | B2 * | 12/2007 | Theus | 362/96 |
| 7,434,960 | B2 * | 10/2008 | Stuhlmacher et al. | 362/253 |
| 2002/0083520 | A1 * | 7/2002 | Osborne-Kirby | 4/678 |
| 2003/0213062 | A1 | 11/2003 | Honda et al. | |
| 2006/0214016 | A1 | 9/2006 | Erdely et al. | |
| 2009/0056011 | A1 * | 3/2009 | Wolf et al. | 4/623 |
| 2011/0185493 | A1 * | 8/2011 | Chen | 4/623 |
| 2011/0209781 | A1 * | 9/2011 | Fath | 137/551 |
| 2011/0210276 | A1 * | 9/2011 | Chen | 251/129.01 |

OTHER PUBLICATIONS

Website publication http://www.marti1921.com/, archived on Mar. 30, 2010.*

* cited by examiner

*Primary Examiner* — Stephen M Hepperle
*Assistant Examiner* — Umashankar Venkatesan

(57) ABSTRACT

A water faucet assembly includes a water conduit that has a first end, a second end and a perimeter wall extending between the first and second ends. The water conduit has a channel therein extending through the first and second ends. The water conduit is comprised of a translucent material to allow light to be transmitted through the water conduit. A temperature sensor is mounted in the water conduit and is in thermal communication with the channel to detect a temperature of water within the channel. A temperature indicator mounted on the water conduit is electrically coupled to the temperature sensor to visually indicate a temperature of water within the channel. A power source is electrically coupled to the temperature sensor and the temperature indicator to supply electric power to the temperature sensor and the temperature indicator.

6 Claims, 6 Drawing Sheets

WATER FAUCET ASSEMBLY

BACKGROUND OF THE DISCLOSURE

Field of the Disclosure

The disclosure relates to water faucet devices and more particularly pertains to a new water faucet device for preventing the leaching of metals into a person's source of water and to indicate a temperature of the water.

SUMMARY OF THE DISCLOSURE

An embodiment of the disclosure meets the needs presented above by generally comprising a water conduit that has a first end, a second end and a perimeter wall extending between the first and second ends. The water conduit has a channel therein extending through the first and second ends. The water conduit is comprised of a translucent material to allow light to be transmitted through the water conduit. A temperature sensor is mounted in the water conduit and is in thermal communication with the channel to detect a temperature of water within the channel. A temperature indicator is electrically coupled to the temperature sensor to visually indicate a temperature of water within the channel. A power source is electrically coupled to the temperature sensor and the temperature indicator to supply electric power to the temperature sensor and the temperature indicator.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
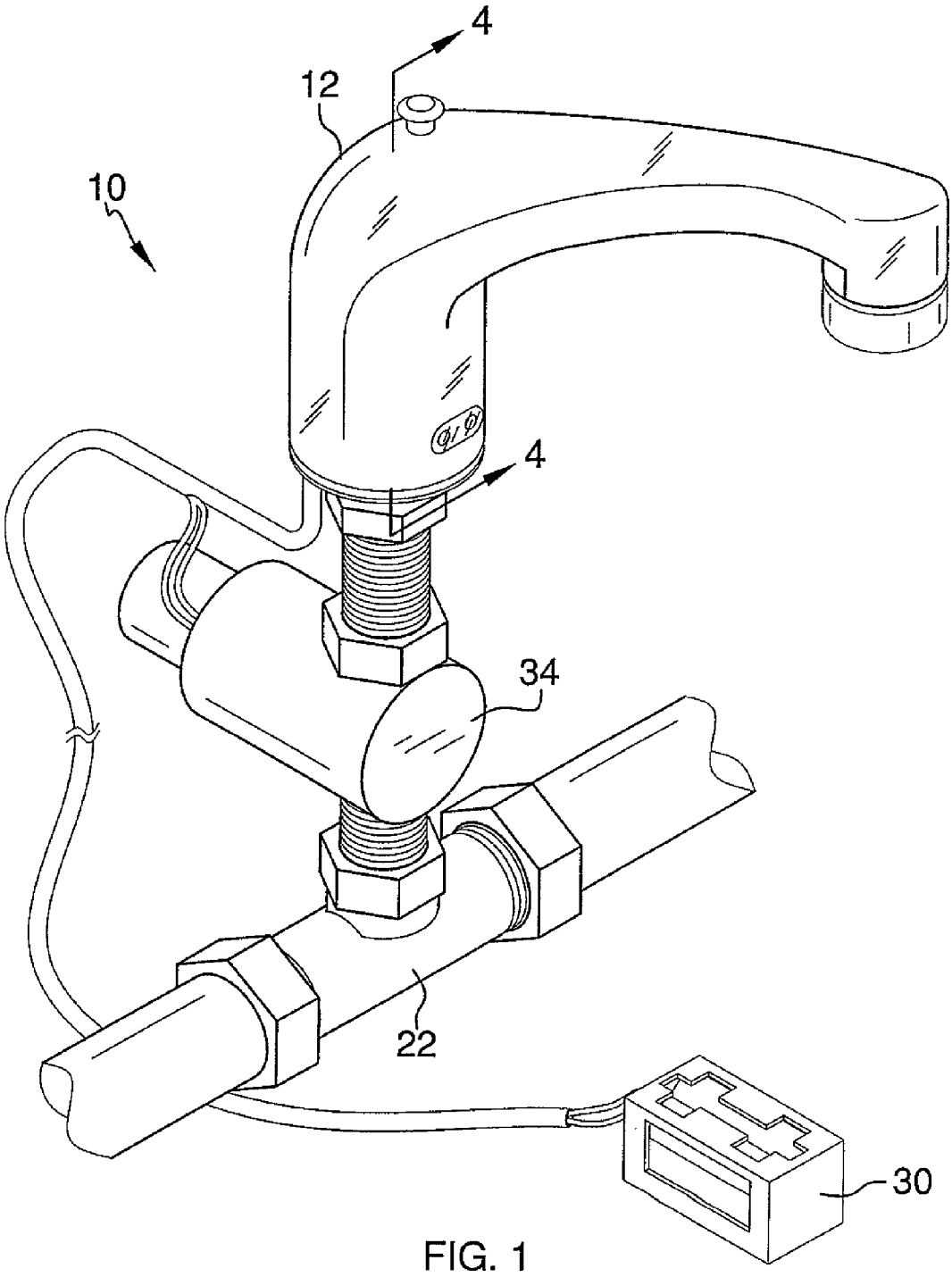
FIG. 1 is a perspective view of a water faucet assembly according to an embodiment of the disclosure.
Figure 2:
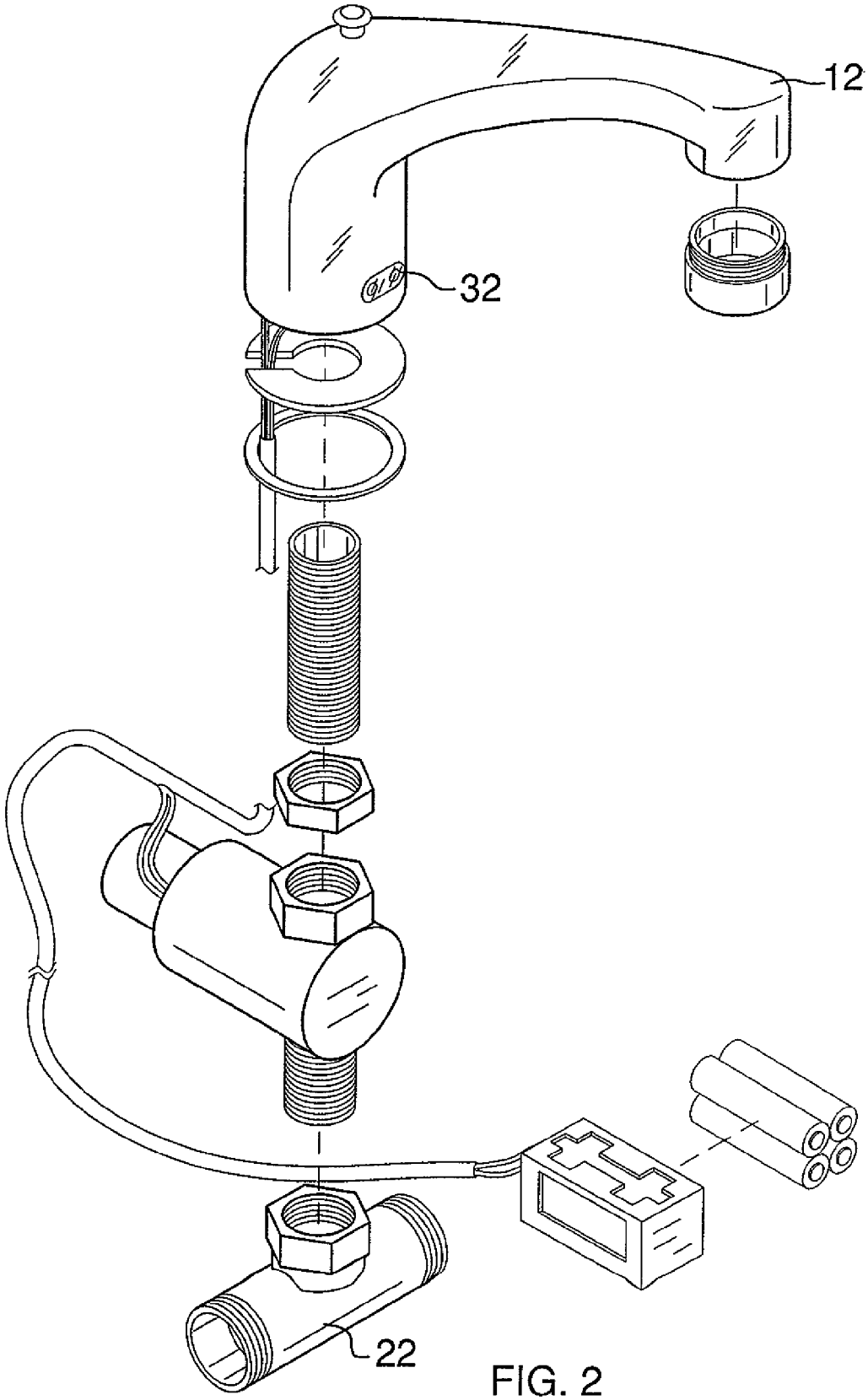
FIG. 2 is an exploded perspective view of an embodiment of the disclosure.
Figure 3:
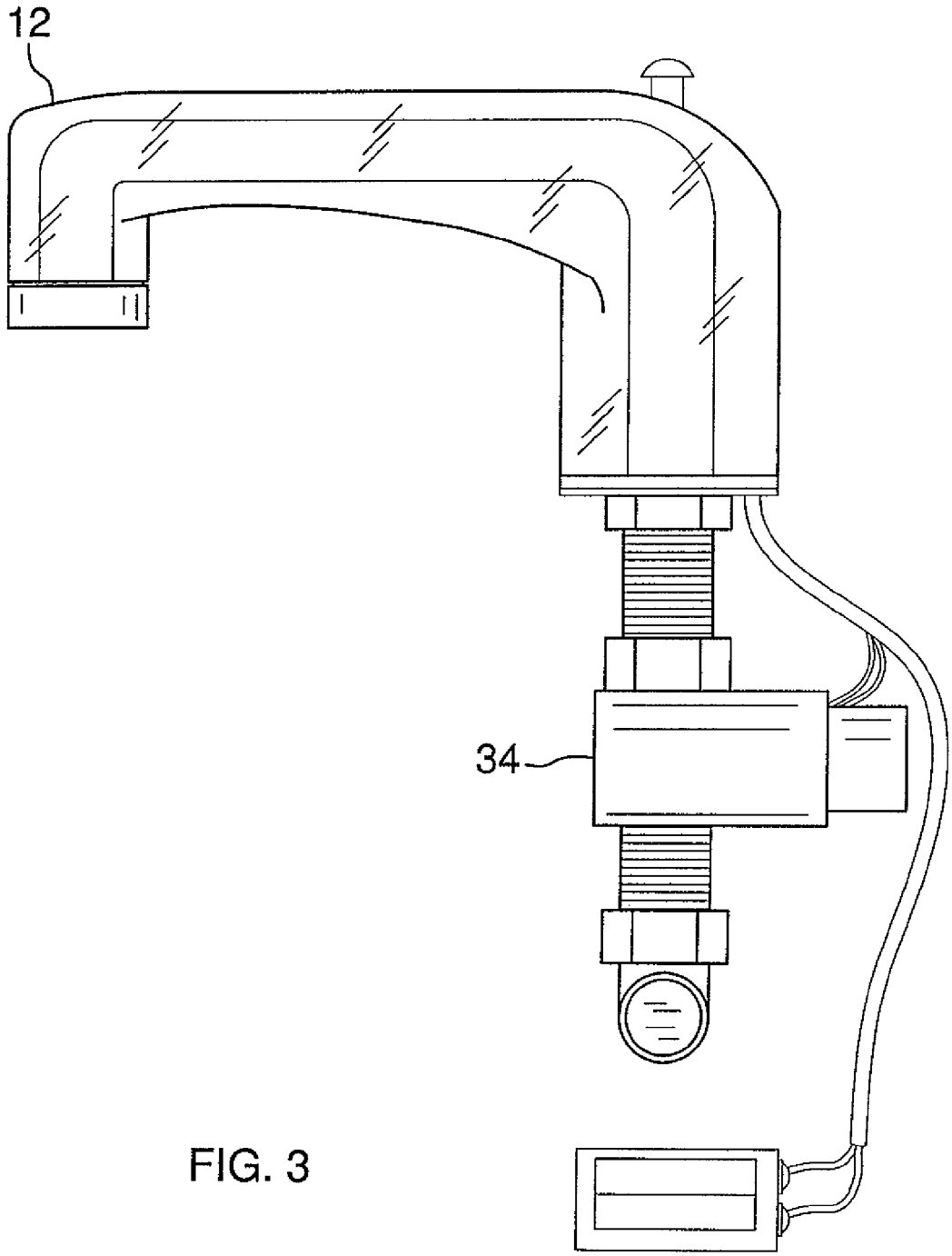
FIG. 3 is a side view of an embodiment of the disclosure.
Figure 4:
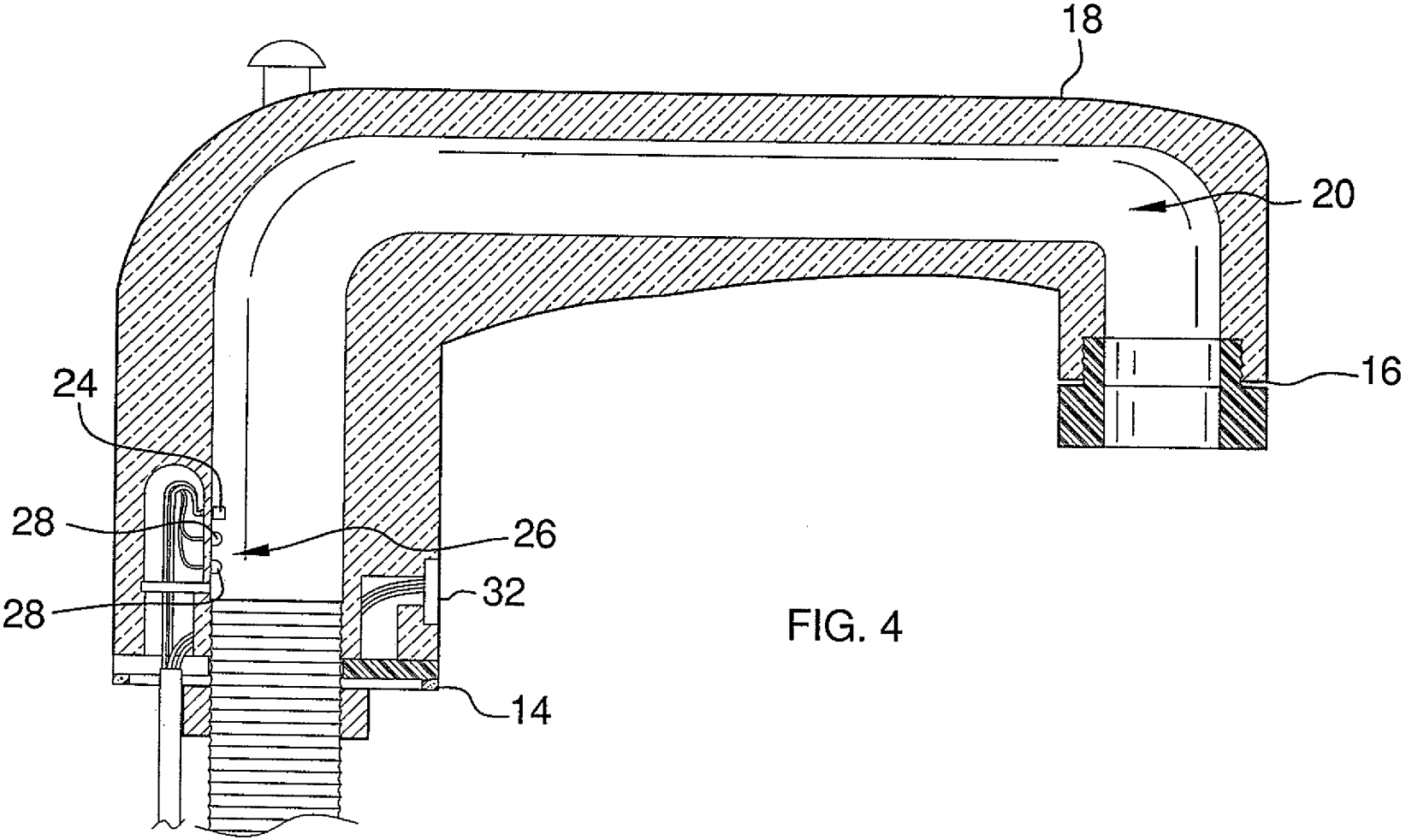
FIG. 4 is a cross-sectional view of an embodiment of the disclosure taken along line 4-4 of FIG. 1.
Figure 5:
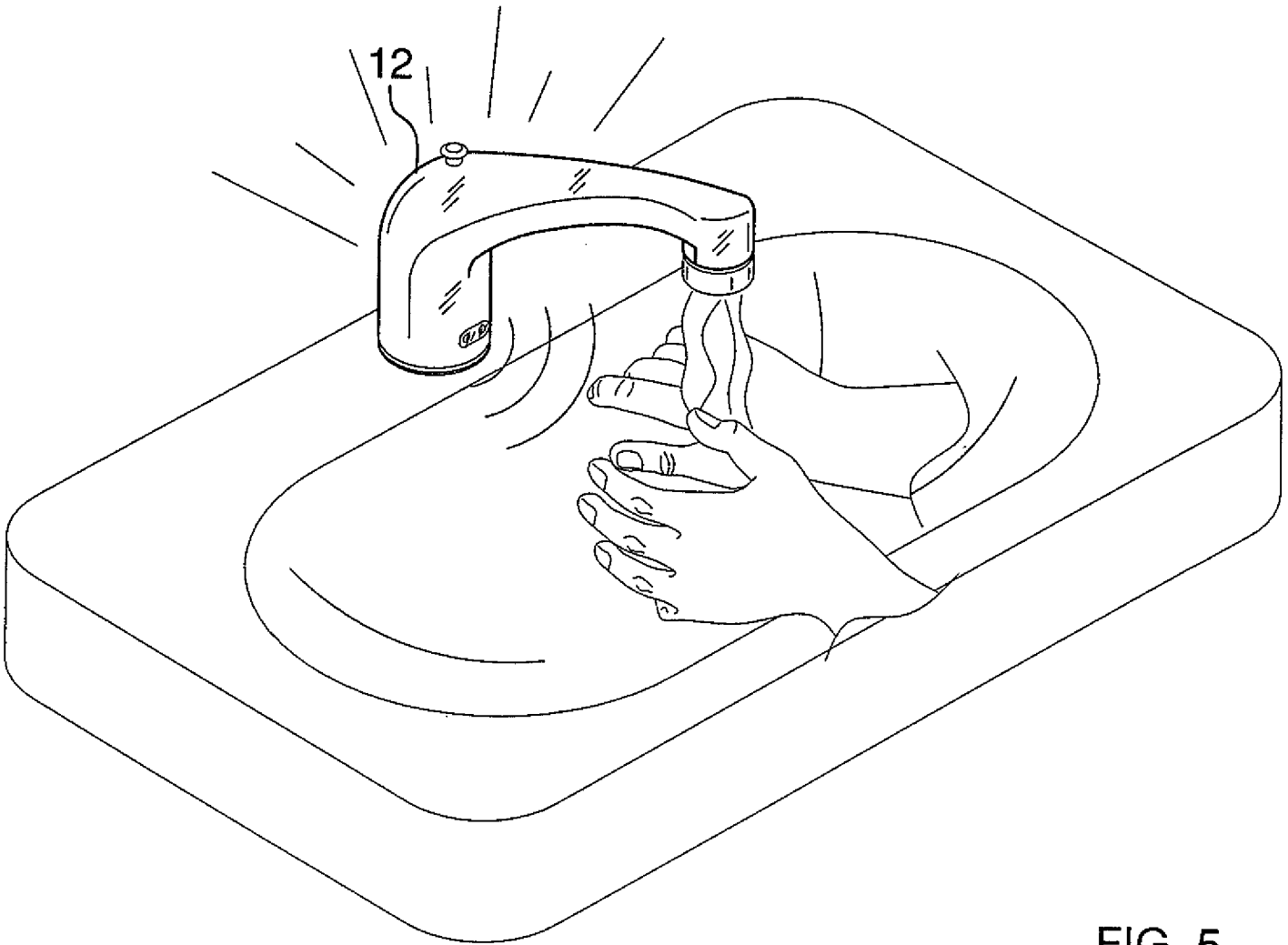
FIG. 5 is a perspective in-use view of an embodiment of the disclosure.
Figure 6:
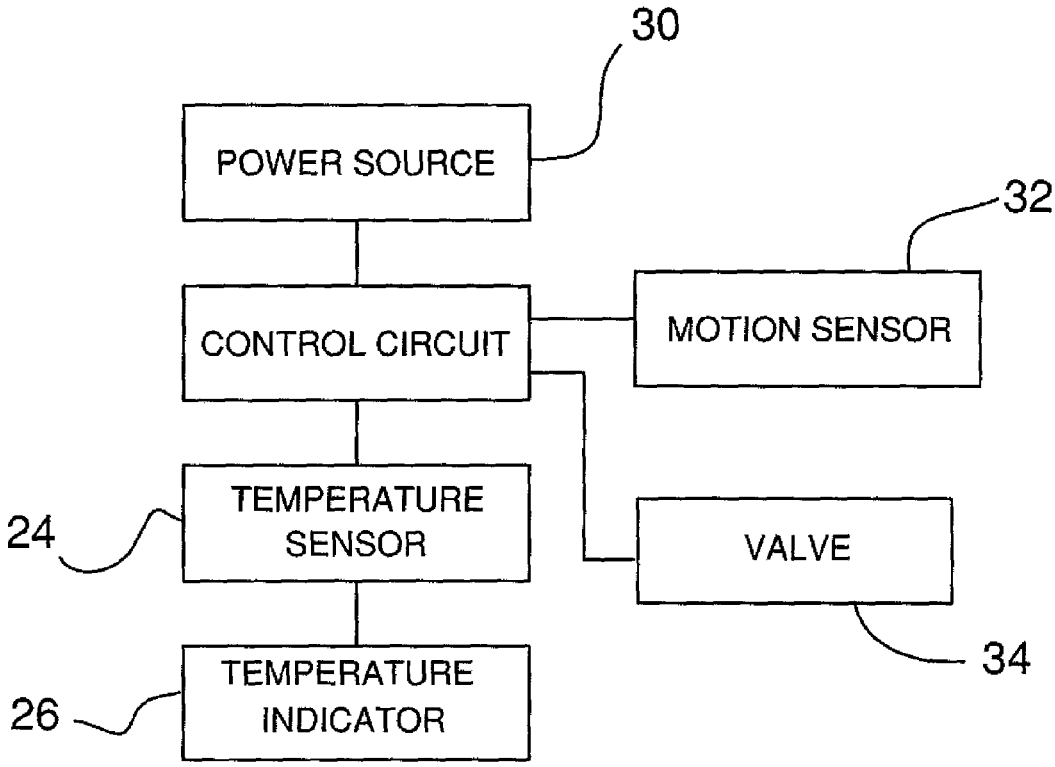
FIG. 6 is a electronic box diagram of an embodiment of the disclosure.

With reference now to the drawings, and in particular to FIGS. 1 through 6 thereof, a new water faucet device embodying the principles and concepts of an embodiment of the disclosure and generally designated by the reference numeral 10 will be described.

As best illustrated in FIGS. 1 through 6, the water faucet assembly 10 generally comprises a water conduit 12 that has a first end 14, a second end 16 and a perimeter wall 18 extending between the first 14 and second 16 ends. The water conduit 12 has a channel 20 therein extending through the first 14 and second 16 ends. The water conduit 12 is comprised of a translucent plastic material to allow light to be transmitted through the water conduit 12. Additionally, the use of a plastic material will prevent toxic metals from leaching into water from the water conduit 12. One type of suitable plastic may be polypropylene. The first end 14 is configured to be fluidly coupled to a water supply 22 and the Figures show conventional faucet gaskets and couplers for accomplishing this.

A temperature sensor 24 is mounted in the water conduit 12 and is in thermal communication with the channel 20 to detect a temperature of water within the channel 20. The sensor 24 is positioned nearer to the first end 14 than the second end 16 to detect the temperature of any water remaining within the channel 20.

A temperature indicator 26 is electrically coupled to the temperature sensor 24 to visually indicate a temperature of water within the channel 20. The temperature indicator 26 includes a plurality of light emitters 28 mounted in the water conduit. At least one of the light emitters 28 emits light to illuminate the water conduit 12 a first color when a temperature of water in the channel 20 is less than 60° Fahrenheit and at least one of the light emitters 28 emits light to illuminate the water conduit 12 a second color when a temperature of water in the channel 20 is more than 80° Fahrenheit. It should be understood that the exact temperatures might be selected by the end user or by a manufacture of the assembly 10. Also, only two light emitters 28 may be used wherein, for instance, the first color may be used for any temperature less than 75° Fahrenheit while the second color may be used for any temperature of 75° Fahrenheit or above. While any color may be used for the first and second colors, the first color will likely comprise a cool color such as green, blue, purple and combinations thereof while and the second color will likely comprise a warm color such as red, orange, yellow and combinations thereof. The light emitters 28 may comprise light emitting diodes, fiber optic cables or a combination of both.

A power source 30 is electrically coupled to the temperature sensor 24 and the temperature indicator 26 to supply electric power to the temperature sensor 24 and the temperature indicator 26. The power source 30 may comprise a battery or the power source 30 may comprise an electrical outlet or hardwired conduit of a dwelling.

A motion sensor 32 is mounted on the water conduit 12 and is in electrical communication with the temperature sensor 24 and the temperature indicator 26 to turn on the temperature sensor 24 and the temperature indicator 26 when the motion sensor 32 detects motion. The motion sensor 32 is conventional though it may include a timer to retain the temperature indicator 26 and the temperature sensor 24 in a powered state for a predetermined amount of time, such as between 1 minute and 5 minutes, to ensure that a person knows that hot water, in particular, may still be located within the channel 20. A valve 34 is in fluid communication with the water conduit 12 and is configured to be fluidly coupled to the water supply 22. The valve 34 is an electrically operated valve, such as a solenoid actuated valve, and is in electrical communication with the motion sensor 32. As such, the valve 34 and motion sensor are also electrically coupled to the power source 30. The valve 34 is opened to allow water to flow from the water supply 22 to the water conduit 12 when the motion sensor 32 detects motion. The valve 34 may be coupled to both hot and cold water supplies to mix them at a predetermined rate to achieve an approximate desired temperature. Alternatively, the assembly 10 may include means, not shown, for increasing or decreasing the hot and cold water supplies independent of each other.

In use, the assembly 10 is coupled to a water source 22 as shown in the Figures and then used as a conventional water faucet. The temperature indicators 26 allow a person to know, before they place their hands in water ejected by the conduit 12, if the water is hot or cold.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A water faucet assembly comprising:

a water conduit having a first end, a second end and a perimeter wall extending between said first and second ends, said water conduit having a channel therein extending through said first and second ends, said water conduit being comprised of a translucent material to allow light to be transmitted through said water conduit, said water conduit comprising a water spout extending upwardly from a sink and said second end comprising a discharge port, said water spout being translucent throughout an outer surface and an inner surface thereof;

a temperature sensor being mounted in said water conduit and being in thermal communication with said channel to detect a temperature of water within said channel;

a temperature indicator being mounted to said water conduit and being electrically coupled to said temperature sensor to visually indicate a temperature of water within said channel, said temperature indicator including light emitters for emitting a cool color when a temperature of water in said channel is less than 60° Fahrenheit and a warm color when a temperature of water is said channel is more than 80° Fahrenheit, said warm color including orange, red, yellow and combinations thereof, said cool color including green, blue, purple and combinations thereof, said light emitters being mounted in said conduit and extending into said channel, said light emitters being positioned nearer to said first end than said second end; and a power source being electrically coupled to said temperature sensor and said temperature indicator to supply electric power to said temperature sensor and said temperature indicator.

2. The assembly according to claim 1, wherein said water conduit is comprised of a plastic material.

3. The assembly according to claim 1, wherein said sensor is positioned nearer to said first end than said second end.

4. The assembly according to claim 1, further including a motion sensor being mounted on said water conduit and being in electrical communication with said temperature sensor and said temperature indicator to turn on said temperature sensor and said temperature indicator when said motion sensor detects motion.

5. The assembly according to claim 4, further including a valve being in fluid communication with said water conduit and being configured to be fluidly coupled to the water supply, said valve being an electrically operated valve, said valve being in electrical communication with said motion sensor, said valve being opened to allow water to flow from the water supply to said water conduit when said motion sensor detects motion.

6. A water faucet assembly comprising:

a water conduit having a first end, a second end and a perimeter wall extending between said first and second ends, said water conduit having a channel therein extending through said first and second ends, said water conduit being comprised of a translucent plastic material to allow light to be transmitted through said water conduit, said first end being configured to be fluidly coupled to a water supply, said water conduit comprising a water spout extending upwardly from a sink and said second end comprising a discharge port, said water spout being translucent throughout an outer surface and an inner surface thereof;

a temperature sensor being mounted in said water conduit and being in thermal communication with said channel to detect a temperature of water within said channel, said sensor being positioned nearer to said first end than said second end;

a temperature indicator being electrically coupled to said temperature sensor to visually indicate a temperature of water within said channel, said temperature indicator including a plurality of light emitters mounted in said water conduit, at least one of said light emitters emitting light to illuminate said water conduit a first color when a temperature of water in said channel is less than 60° Fahrenheit, at least one of said light emitters emitting light to illuminate said water conduit a second color when a temperature of water in said channel is more than 80° Fahrenheit, said first color being a cool color, said second color being a warm color, said warm color including orange, red, yellow and combinations thereof, said cool color including green, blue, purple and combinations thereof, said light emitters being mounted in said conduit and extending into said channel, said light emitters being positioned nearer to said first end than said second end;

a power source being electrically coupled to said temperature sensor and said temperature indicator to supply electric power to said temperature sensor and said temperature indicator;

a motion sensor being mounted on said water conduit and being in electrical communication with said temperature sensor and said temperature indicator to turn on said temperature sensor and said temperature indicator when said motion sensor detects motion; and a valve being in fluid communication with said water conduit and being configured to be fluidly coupled to the water supply, said valve being an electrically operated valve, said valve being in electrical communication with said motion sensor, said valve being opened to allow water to flow from the water supply to said water conduit when said motion sensor detects motion.

* * * * *